US006152799A

United States Patent [19]

Arriola

[11] Patent Number: 6,152,799

[45] Date of Patent: Nov. 28, 2000

[54] WING MOTION TOY FIGURE USING LEG MOVEMENT

[75] Inventor: Martin F. Arriola, Torrance, Calif.

[73] Assignee: Mattel, Inc., El Segundo

[21] Appl. No.: 09/240,894

[22] Filed: Jan. 29, 1999

[51] Int. Cl.[7] ..... A63H 3/20

[52] U.S. Cl. ..... 446/330; 446/322; 446/317; 446/338; 446/339; 446/340

[58] Field of Search ..... 446/322, 323, 446/317, 330, 338, 339, 340

[56] References Cited

U.S. PATENT DOCUMENTS

| | | | |
|---|---|---|---|
| 140,259 | 6/1873 | Eaton . | |
| 1,800,775 | 4/1931 | Bostwick . | |
| 2,158,860 | 5/1939 | Hyde . | |
| 3,147,566 | 9/1964 | Ong . | |
| 4,307,533 | 12/1981 | Sims et al. . | |
| 4,571,206 | 2/1986 | Mayer et al. | 446/330 |
| 4,579,542 | 4/1986 | Mayer et al. . | |
| 4,596,532 | 6/1986 | Cook et al. | 446/330 |
| 4,605,382 | 8/1986 | Cook et al. . | |
| 4,608,026 | 8/1986 | Newton et al. . | |
| 4,666,419 | 5/1987 | Droller et al. | 446/330 |
| 4,710,146 | 12/1987 | Rasmussen et al. . | |
| 4,718,877 | 1/1988 | Girsch et al. . | |
| 5,167,562 | 12/1992 | Axtell . | |
| 5,478,269 | 12/1995 | Wolfram . | |
| 5,489,466 | 2/1996 | Inaba et al. | 428/212 |
| 5,701,878 | 12/1997 | Moore et al. . | |
| 5,727,982 | 3/1998 | Hurt | 446/352 |
| 5,964,638 | 10/1999 | Emerson | 446/339 |

*Primary Examiner*—Sam Rimell
*Assistant Examiner*—Kevin Hughes
*Attorney, Agent, or Firm*—Roy A. Ekstrand

[57] ABSTRACT

A toy figure includes a body, a pair of wings, a pair of legs, a tail, and a head converted to generally resemble a bird or other flying creature. The legs and wings are pivotally mounted to the body using a mechanism by which the pivotal movement of the legs in response to the user squeezing and releasing them repeatedly produces a corresponding wing-flapping action. A spring urges the wings to a raised position and urges the legs to a spread position. The head is pivotally supported by the body and a cam follower and cam arrangement couples the head to the wing movement apparatus such that the head moves side-to-side simultaneous with the wing-flapping movement.

8 Claims, 3 Drawing Sheets

WING MOTION TOY FIGURE USING LEG MOVEMENT

FIELD OF THE INVENTION

This invention relates generally to articulated toy figures and particularly to those having movable wings.

BACKGROUND OF THE INVENTION

Articulated toy figures are well known in the art and have been provided in a virtually endless variety of functions and appearances. Such figures have included a torso or body supporting a plurality of limbs with at least some of the limbs being movable upon the torso or body. Such articulated limbs are often accompanied by a spring mechanism usually supported within the torso or body which biases the limb positions toward a particular configuration. Also, in most of such toy figures, two or more of the limbs are interconnected within the body by a drive apparatus with the result that movement of one or more limbs often causes a corresponding motion of the alternate limbs. Such toy figures are usually formed of relatively low cost, high volume components fabricated by processes such as plastic molding or the like.

Among the various articulated figures which have emerged in the toy art, those having a pair of wings supported to provide a wing flapping flying action have enjoyed great popularity. While particular structures of such wing flapping articulated toy figures is subject to substantial variation, generally most provide a pair of wings, or more, pivotally attached to an internal attachment and support. Further, in most instances, a drive mechanism, often provided by movement of one or more limbs, is coupled to the pivotal attachment and support to produce a wing flapping or flying action for the toy figure.

For example, U.S. Pat. No. 4,571,206 issued to Mayer, et al. sets forth an ACTION FIGURE WITH WING MOVEMENT DERIVED FROM LEG MOVEMENT having a torso and a pair of legs pivotally mounted thereto. A pair of pivotally mounted wings are supported by the torso and an actuating mechanism within the torso converts the rocking movement of the legs to pivotal movement of the wings.

U.S. Pat. No. 4,718,877 issued to Girsch, et al. sets forth a WINGED TOY having a flexible hollow body resembling that of a butterfly. Wings are secured to the hollow body and, upon distortion as by squeezing, the angular positions of the wings are changed. Thus, by squeezing and releasing the hollow body repeatedly, the wings can be made to flap.

U.S. Pat. No. 5,167,562 issued to Axtell sets forth a TAIL PULL AND WING FLAP ANIMATION APPARATUS having a bird-like figure supporting a pair of wings in movable attachment and an extendible tail. Apparatus is provided coupling the tail movement to the wings to produce wing motion.

U.S. Pat. No. 5,478,269 issued to Wolfram sets forth a TOY FIGURE HAVING GRASPING CLAW in which a body supports a movable leg and a pair of extending arm claws. Apparatus is coupled between the movable leg and one of the claws to close the pincer portion of the claw when the leg is moved.

U.S. Pat. No. 4,605,382 issued to Cook, et al. sets forth a FIGURE WHEREIN LEG MOVEMENT PRODUCES WING-LIKE MOVEMENT OF ARMS having a torso supporting a pair of arms pivotable in the vertical direction together with a pivotally movable leg. A drive mechanism couples the pivotal movement of the leg to the arms raising and lowering them in the vertical direction.

U.S. Pat. No. 4,579,542 issued to Mayer, et al. sets forth an ACTION FIGURE WITH ARM MOVEMENT DERIVED FROM LEG MOVEMENT having a torso supporting two pivotally mounted arms together with a pivotally mounted leg. A helical drive mechanism is coupled between the arms and an extending lever is coupled to the pivotal leg. A linkage arm is further coupled from the helical member to the arm of the pivoting leg such that pivotal motion of the leg rotates the helical member causing a corresponding pivotal motion of the arms.

U.S. Pat. No. 4,596,532 issued to Cook, et al. sets forth an ACTION FIGURE IN WHICH MANIPULATION OF ONE LEG PRODUCES A HORIZONTAL SWINGING OF BOTH ARMS having a torso supporting at least one pivotal leg and a pair of arms pivotable at their shoulder joints. A pair of arm carriers within the torso interior is coupled to the pivotable leg such that leg motion produces horizontal plane rotation of the arms.

U.S. Pat. No. 4,608,026 issued to Newton, et al. sets forth a FIGURE WHEREIN MANIPULATION OF ONE LIMB CAUSES MOTION OF ANOTHER having a torso supporting at least one leg in pivotal attachment and a pair of arms such that one of the arms is also pivotally supported. A drive mechanism is provided which couples the pivoting motion of the leg to the arm and thereby produces a corresponding pivotal motion therein.

U.S. Pat. No. 5,727,982 issued to Hurt sets forth an ACTION FIGURE WITH ROTATING ARM MECHANISM having a torso supporting a rotating appendage. The rotating appendage is activated by pivoting one leg of the figure toward the other leg overcoming the bias of a spring to pivot an internal lever which imparts linear movement to a follower. The follower includes a cam for engaging helical ribs on the arm shaft to translate linear motion of the follower to rotary motion of the arm shaft and arm.

U.S. Pat. No. 5,701,878 issued to Moore, et al. sets forth a TOY GUN HAVING A TRIGGER ASSEMBLY FOR AIMING AND LAUNCHNG A PROJECTILE FROM A FLEXIBLE APPENDAGE having a projectile support secured to a flexible tail of a scorpion-like figure. A compressed gas mechanism is provided for launching projectiles from the scorpion tail.

U.S. Pat. No. 4,710,146 issued to Rasmussen, et al. sets forth a PROJECTILE PROPELLING ATTACHMENT FOR TOY FIGURES having a housing configured to comprise a shoulder launched missile firing device within which a spring-loaded mechanism is operative to launch a projectile when the device is cocked and fired.

While the foregoing described prior art devices have improved the art and in some instances enjoyed commercial success, there remains nonetheless a continuing need in the art for evermore amusing, entertaining, and improved articulated toy figures which provide wing flapping action.

SUMMARY OF THE INVENTION

Accordingly, it is a general object of the present invention to provide an improved articulated toy figure. It is a more particular object of the present invention to provide an improved articulated toy figure which includes wing motion apparatus. It is a still more particular object of the present invention to provide an improved articulated toy figure in which wing motion is derived from leg movement using a simple, low cost mechanism. It is a still further object of the present invention to provide an improved wing motion toy figure which also provides a head motion during wing motion.

In accordance with the present invention, there is provided a toy figure having wing-flapping motion, the toy figure comprising: a body having an interior cavity, a head end and a tail end; a head pivotally coupled to the head end to facilitate head movement side-to-side relative to the body; a pair of barrel segments pivotally supported within the interior cavity, each of barrel segments having a forward end supporting a cam and a rearward end supporting a leg post; a pair of wings each wing being coupled to one of the barrel segments; a pair of legs each leg being coupled to one of the leg posts; a cam follower and head coupler for converting movement of the cams to the side-to-side movement of the head, the legs being pivoted inwardly to pivot the barrel segments in a first direction and outwardly to pivot the barrel segments in a second direction whereby repetitively squeezing the legs together and moving them apart causes the wings to flap and the head to move side-to-side.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
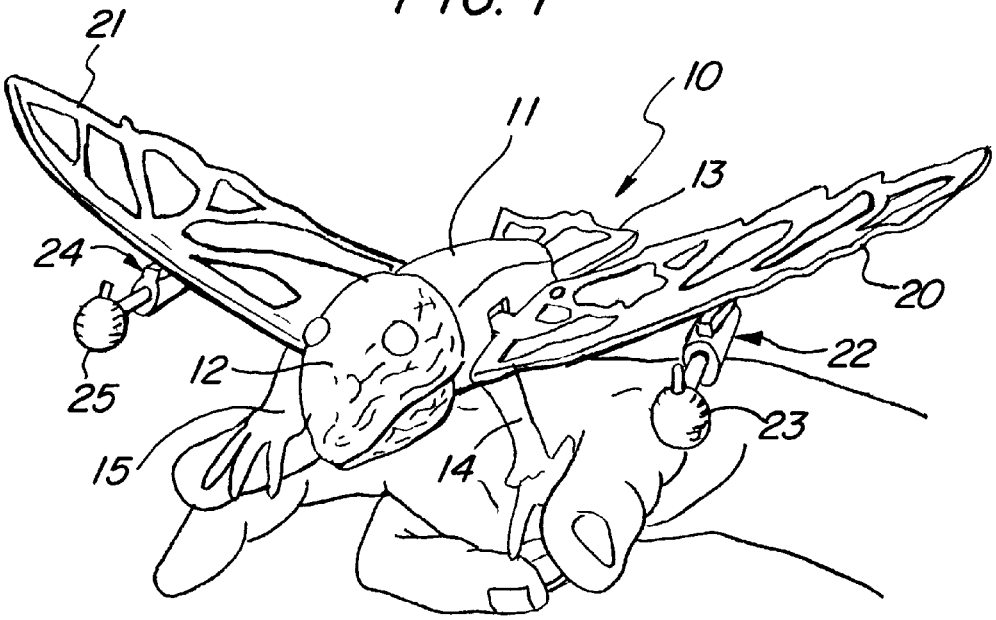
FIG. 1 sets forth a perspective view of a wing motion toy figure constructed in accordance with the present invention in the wings raised position.

FIG. 1 sets forth a perspective view of a wing motion toy figure construction in accordance with the present invention and generally referenced by numeral 10. Toy FIG. 10 includes a body 11, a head 12, a tail 13, a pair of wings 20 and 21, and a pair of legs 14 and 15 configured to generally resemble a bird or similar flying creature. It will be apparent to those skilled in the art from the descriptions which follow that a variety of appearance characteristics maybe utilized to alter the appearance of toy FIG. 19 without departing from the spirit and scope of the present invention. Wing 20 further supports a projectile launcher 22 having a projectile 23 secured therein. Similarly, wing 21 supports a projectile launcher 24 having a projectile 25 received therein.

In operation, the user holds legs 14 and 15 in the manner shown and, as is described below, moves wings 20 and 21 by squeezing legs 14 and 15 together and releasing them in a repeated motion. FIG. 1 shows the positions of legs 14 and 15*a* as well as wings 20 and 21 in the "relaxed" position in which the mechanism set forth below biases legs 14 and 15 outwardly and biases legs 20 and 21 upwardly.

Projectile launchers 22 and 24 are fabricated in accordance with conventional fabrication techniques and include spring mechanism (not shown) which operate in a conventional manner to launch projectiles 23 and 25. Thus, with toy 10 in the relaxed position of FIG. 1, wings 20 and 21 are angled in a typical flight attitude and the user may simply play with toy FIG. 10 in a more or less conventional play pattern. In addition, the user is able to squeeze legs 14 and 15 together to flap wings 20 and 21 in the manner set forth below.

Figure 2:
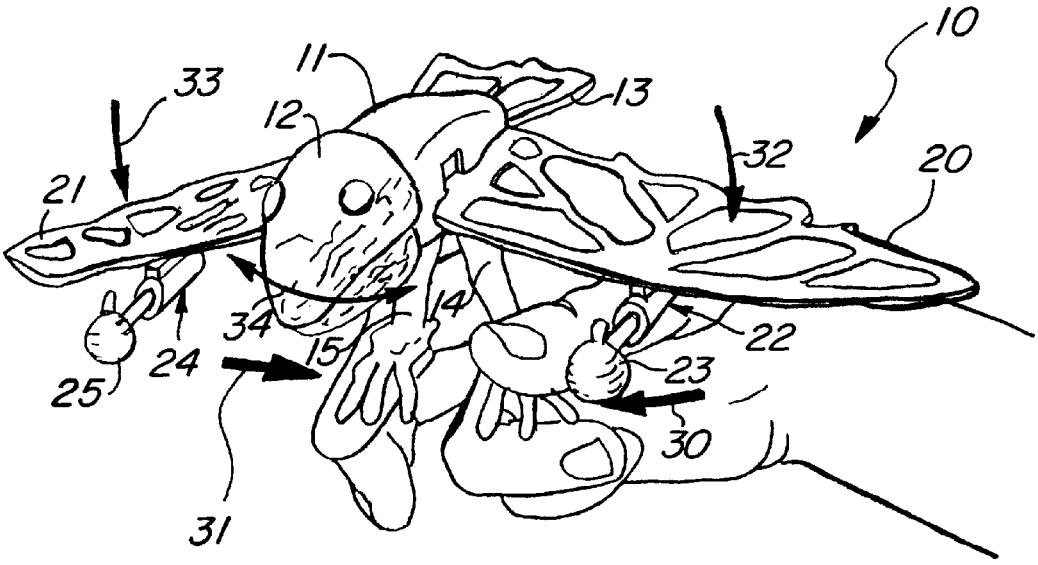
FIG. 2 sets forth a perspective view of the present invention wing motion toy figure in the wings lowered position.

FIG. 2 sets forth a perspective view of toy FIG. 10 in the wings down configuration which results from the user having squeezed legs 14 and 15 together. Thus, toy FIG. 10 includes a body 11 supporting a head 12 and a tail 13. Toy 10 further includes legs 14 and 15 as well as wings 20 and 21. Wing 20 supports a projectile launcher 22 having a projectile 23 therein while wing 21 supports a projectile launcher 24 having a projectile 25 therein. By means set forth below in greater detail, head 12 is pivotally secured to body 11 and is operatively coupled to the internal mechanism (seen in FIGS. 3, 4 and 5) responding to movement of legs 14 and 15 to cause head motion from side to side.

Thus, in operation, as the user's squeezes legs 14 and 15 inwardly in the directions indicated by arrows 30 and 31, the operative mechanism within body 11 described below, pivot wings 20 and 21 downwardly about body 11 in the directions indicated by arrows 32 and 33. As the user releases the inward force upon legs 14 and 15 allowing them to move outwardly and separate, wings 20 and 21 pivot upwardly toward the wings up position of FIG. 1. Thus, as the user repeatedly squeezes legs 14 and 15 together and releases them, wings 20 and 21 undergo a flapping motion.

In addition, to wing motion and by means set forth below in FIGS. 3 through 5, the wing flapping mechanism within body 11 is also coupled to head 12 whereby head 12 undergoes side to side pivotal movement in the direction indicated by arrow 34 as legs 14 and 15 are repeatedly squeezed together and released. Thus, the child user is able to grasp toy FIG. 10 by one hand and with a simple squeeze and release motion provide a flying or wing flapping action of the toy figure which is enhanced by side-to-side head motion characteristic of certain birds or other flying creatures.

Figure 3:
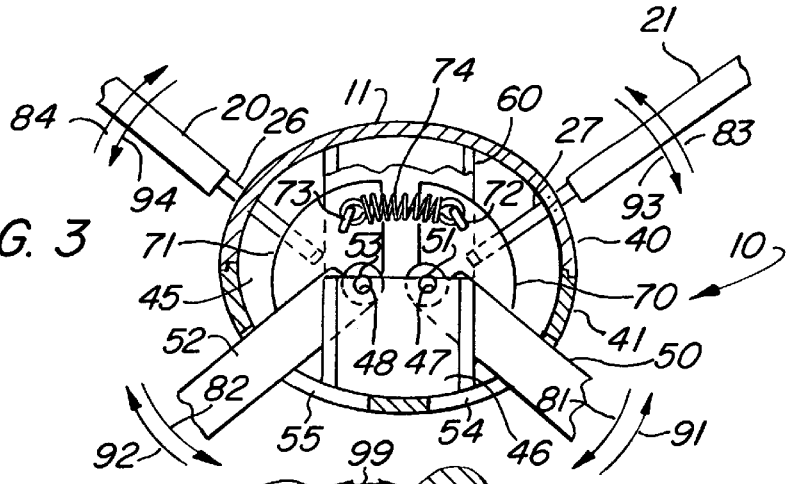
FIG. 3 sets forth a partial section view of the wing motion drive mechanism of the present invention toy figure taken along section lines 3—3 in FIG. 4.
Figure 4:
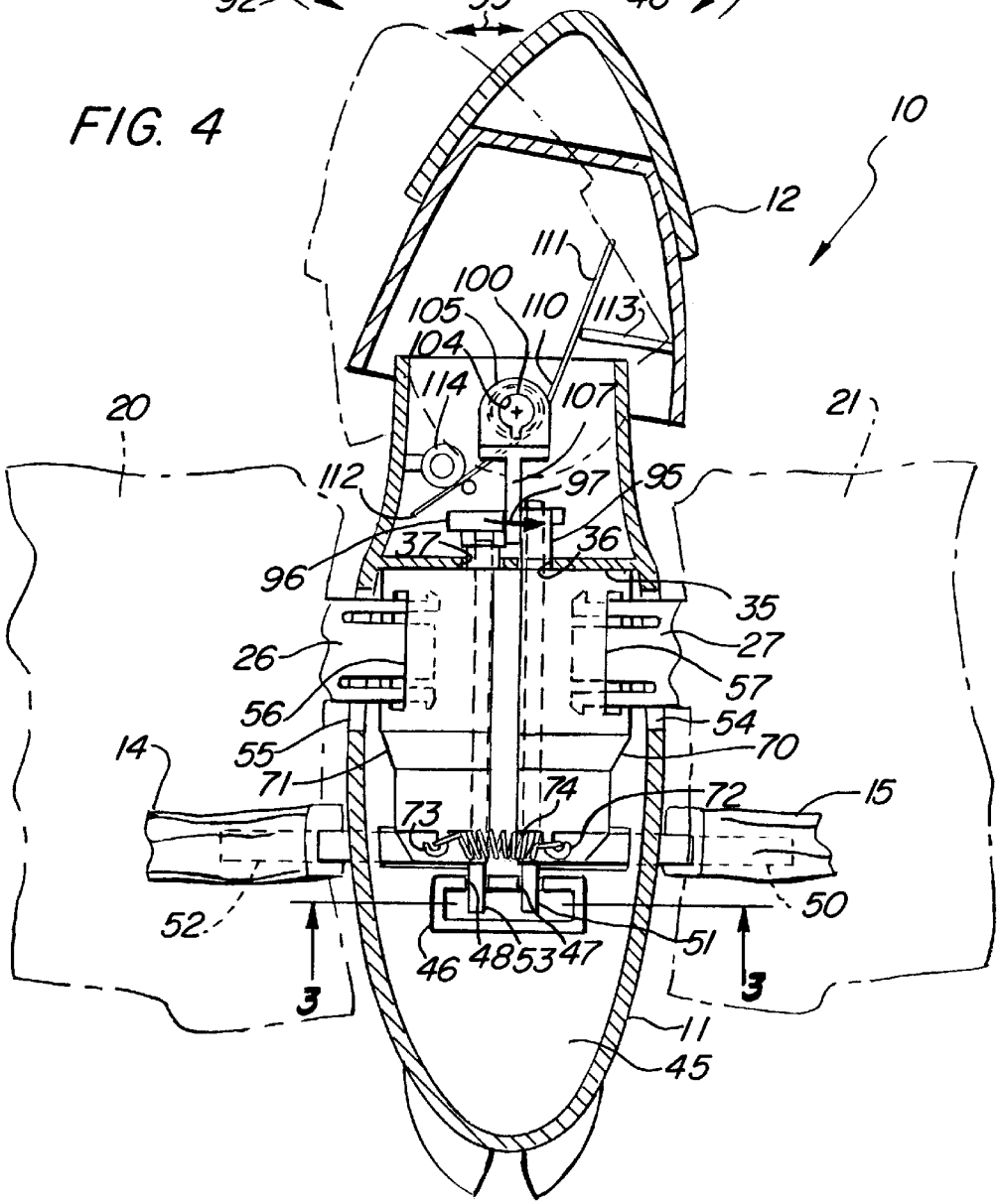
FIG. 4 sets forth a partial section top view of the present invention wing motion toy figure.

FIG. 3 sets forth a partial section view of toy FIG. 10 taken along section lines 3—3 in FIG. 4. As described above, toy 10 includes a body 11 supporting a pair of wings 20 and 21. Body 11 is fabricated of a pair of mating half portions 40 and 41 which are joined to form body 11 using conventional fastening apparatus (not shown). An interior cavity 45 is formed within body 11. A pivot support 46 extends upwardly from body portion 41 while a pivot support 60 extends downwardly from body portion 40. Pivot supports 46 and 60 meet to captivate a pair of shafts 51 and 53 within a pair of notches 47 and 48. As is better seen in FIG. 4, shafts 51 and 53 extend a substantial length within body 11 and provide a rotatable support for a pair of barrel segments 70 and 71. Barrel segment 70 includes a leg post 50 joined thereto while barrel segment 71 includes a leg post 52 joined thereto. A pair of tabs 72 and 73 are formed on barrel segments 70 and 71 respectively and a spring 74 is stretched between tabs 72 and 73. As is better seen in FIG. 4, legs 14 and 15 are secured to leg posts 58 and 50 respectively.

Wing 20 includes a wing coupler 26 which passes through a slot 62 (seen in FIG. 4) formed in body 11 and is snap-fitted to barrel segment 71 via a slot 56 (seen in FIG. 4) formed therein. Similarly, wing 20 includes a wing coupler 27 extending through a slot 63 (seen in FIG. 4)

formed in body 11. Barrel segment 70 includes a slot 57 (seen in FIG. 4) which receives wing coupler 27 in a snap-fit attachment. Thus, wing couplers 26 and 27 secure wings 20 and 21 in a fixed attachment to barrel segments 71 and 70 such that pivotal movement of the barrel segments produces a corresponding pivotal movement of wings 20 and 21.

In operation assuming the initial configuration of toy 10 shown in FIG. 3 which may be described as a "relaxed position", leg posts 50 and 52 are pivoted to their spread position by the force of spring 74 upon barrel segments 71 and 70. Concurrently, wings 20 and 21 assume the upward angled positions shown in FIG. 3. Thus, FIG. 3 in its relaxed configuration represents the configuration of toy FIG. 10 in the absence of inward force upon the figure's legs.

As the user initiates wing-flapping action by squeezing legs 14 and 15 (seen in FIG. 2) together, leg posts 50 and 52 are pivoted inwardly in the manner indicated by arrows 81 and 82. This pivotal motion of leg posts 50 and 52 produces a corresponding pivotal motion of barrel segments 70 and 71. The attachment of wing couplers 26 and 27 to barrel segments 71 and 70 respectively results in a downward pivotal movement of wings 20 and 21 in the direction indicated by arrows 94 and 93 respectively. The squeezing together of the figure's legs overcomes the force of spring 74 stretching the spring between the barrel segments as they pivot. The pivotal movement of leg posts 50 and 52 is facilitated by a pair of slots 54 and 55 formed in body 11.

Once legs 14 and 15 (seen in FIG. 2) have reached their innermost travel and wings 20 and 21 have pivoted downwardly their maximum travel, the user then releases the squeezing pressure upon legs 14 and 15 allowing the force of spring 74 to pivot barrel segments 70 and 71 in the direction indicated by arrows 83 and 84. This pivotal movement carries wings 21 and 20 in a corresponding upward pivotal movement. The attachment of leg posts 50 and 52 to barrel segments 70 and 71 causes leg posts 50 and 52 to pivot apart in the directions indicated by arrows 91 and 92. This motion of leg posts 50 and 52 carries legs 14 and 15 toward the relaxed position shown in FIG. 1. This cycle is repeated as the user squeezes and releases legs 14 and 15 (seen in FIG. 1) to provide a wing flapping motion for toy FIG. 10.

FIG. 4 sets forth a partial section view of toy FIG. 10 showing the apparatus by which the movement of legs 14 and 15 results in pivotal movement of wings 20 and 21 together with side-to-side motion of head 12. Thus, as described above, toy FIG. 10 includes a body 11 defining an interior cavity 45. Body 11 further includes a pivot support 46 defining a pair of notches 47 and 48 therein. Body 11 further defines a wall 35 having a corresponding pair of notches 36 and 37 formed therein. Body 11 further defines a post 114 and a post 100. Post 100 includes an elongated tab 101 formed at the rear portion thereof. Body 11 further includes a pair of slots 54 and 55 extending horizontally on opposite sides of body 11.

A barrel segment 70 is supported by a shaft 51 extending from notch 47 of pivot support 46 forwardly through notch 36 formed in wall 35. Barrel segment 70 further includes a cam 95 (better seen in FIG. 5). Barrel segment 70 further defines a slot 57 which receives wing coupler 27 in a snap-fit attachment to secure wing 21 to barrel segment 70.

Similarly, barrel segment 71 is pivotally supported within body 11 by a shaft 53 extending from notch 48 of pivot support 46 forwardly through notch 37 of wall 35. Barrel segment 71 further defines a slot 56 which receives wing coupler 26 of wing 20 in a snap-fit attachment. Slots 54 and 55 formed in body 11 facilitate the pivotal movement of wing couplers 27 and 26 described above.

A pair of tabs 72 and 73 are formed on barrel segments 70 and 71 respectively and a return spring 74 is stretched therebetween. Spring 70 functions to urge barrel segments 70 and 71 toward the "relaxed" position shown in FIG. 3. A pair of leg posts 50 and 58 extend downwardly and outwardly and are joined to a pair of legs 15 and 14 respectively.

In accordance with a further advantage of the present invention, toy FIG. 10 includes a head 12 having a post 100 extending upwardly therefrom. Post 100 is generally cylindrical and passes through an aperture formed in body 11 (not shown) allowing post 100 to extend upwardly from body 11 and receive a head coupler 105. Post 100 further includes an elongated tab 101. Head coupler 105 defines a cylindrical passage 104 having an elongated key notch 108 formed therein. Passage 104 and notch 108 cooperate to receive 100 and engage tab 101. As a result, pivotal movement of head 12 is coupled to head coupler 105. A coil spring 110 includes an end 111 contacting an inner wall 113 formed in head 12. Spring 110 further includes an end 112 captivated against post 114 of body 11. Spring 110 provides a residual spring force tending to pivot head 12 to the right side position shown in solid-line representation.

Head coupler 105 further includes a pair of cam followers 106 and 107 (cam follower 106 seen in FIG. 5) which extend rearwardly and which contact cams 95 and 96 of barrel segments 70 and 71. The configuration of head coupler 105, cams 95 and 96 and barrel segments 70 and 71 is shown in perspective view in FIG. 5. However, suffice it to note here that the pivotal movement of barrel segments 70 and 71 described above and resulting from squeezing together and releasing legs 14 and 15 pivots 95 and 96 against cam followers 106 and 107 respectively to pivot head coupler 105 in the side-to-side manner indicated by arrows 99. Thus, a side-to-side head motion is provided in combination with a wing flapping motion as the user squeezes and releases legs 14 and 15.

Figure 5:
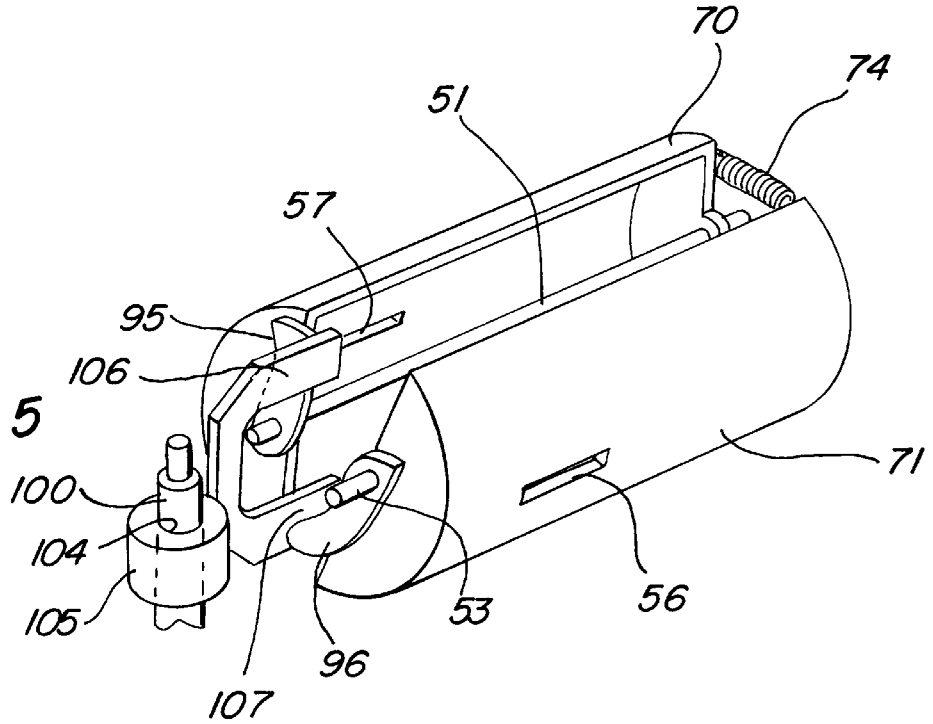
FIG. 5 sets forth a perspective view of the major components of the wing motion drive of the present invention toy figure.

FIG. 5 sets forth a perspective view of the operative mechanism by which the present invention toy figure produces head movement. As described above, toy FIG. 10 includes a pair of barrel segments 70 and 71 supported by a pair of shafts 51 and 53. As is also described above, barrel segments 70 and 71 include respective cams 95 and 96 joined thereto. A pair of slots 56 and 57 are formed in barrel segments 71 and 70 to secure wing couplers 26 and 27 (seen in FIG. 4). A spring 74 is stretched between barrel segments 70 and 71. As described above, shafts 51 and 53 pivotally support segments 70 and 71 respectively within the interior of the toy figure body.

A post 100 extends upwardly from head 12 (seen in FIG. 4) and a head coupler 105 includes a passage 104 allowing post 100 to be engagingly receive within head coupler 105. Head coupler 105 includes a pair of cam followers 106 and 107 which are positioned within the travel paths of cams 95 and 96.

Thus, in operation as barrel segments 70 and 71 are pivoted in response to the user squeezing and releasing the toy figure's leg and, as is shown above in FIGS. 1 through 4, a corresponding pivotal movement of cams 95 and 96 exerts a forth against cam followers 106 and 107 which pivots head couplers 105. The pivotal movement of head coupler 105 is transferred to head 12 (seen in FIG. 4) by the engagement of post 100 within passage 104 of head coupler 105.

What has been shown is a wing motion toy figure which utilizes leg movement to provide simultaneous wing-flapping action together with side-to-side movement of the toy figure's head portion. The mechanism provided is relatively simple and low cost in its assembly. The wings are joined to the toy figure by snap-fit attachment which protects the wings against excessive forces and stresses during play.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure having wing-flapping motion, said toy figure comprising:

a body having an interior cavity, a head end and a tail end;

a head pivotally coupled to said head end to facilitate head movement side-to-side relative to said body;

a pair of barrel segments pivotally supported within said interior cavity, each of said barrel segments having a forward end supporting a cam and a rearward end supporting a leg post, said pair of barrel segments including a first spring coupled between said barrel segments to urge said barrel segments to pivot such that said leg posts are pivoted apart;

a pair of wings each wing being coupled to one of said barrel segments;

a pair of legs each leg being coupled to one of said leg posts;

a cam follower and head coupler for converting movement of said cams to said side-to-side movement of said head, wherein said legs can pivot inwardly, causing said barrel segments to pivot in a first direction, and then said legs can pivot back outwardly, causing said barrel segments to pivot in a second direction whereby repetitively squeezing said legs together and moving them apart causes said wings to flap and said head to move side-to-side.

2. The toy figure set forth in claim 1 wherein said head includes a second spring coupled between said head and said body urging said head toward one side.

3. The toy figure set forth in claim 2 wherein said head includes a post and wherein said head coupler defines an aperture received upon said post and said cam follower includes a pair of followers each contacting at least one of said cams.

4. The toy figure set forth in claim 1 wherein said head includes a second spring coupled between said head and said body urging said head toward one side.

5. The toy figure set forth in claim 4 wherein said head includes a post and wherein said head coupler defines an aperture received upon said post and said cam follower includes a pair of followers each contacting at least one of said cams.

6. A toy figure comprising:

a body, a pair of wings, a pair of legs and a head;

a first pivot mechanism supported within said body having a pair of leg posts coupled to said pair of legs and wing couplers joined to said pair of wings; and a second pivot mechanism, supported within said body, pivotally supporting said head and coupling said head to said first pivot mechanism, said first pivot mechanism operative in response to movement of said legs together and apart to corresponding pivot said wings and said second pivot mechanism being driven by said first pivot mechanism to move said head side-to-side and said head including a second spring coupled between said head and said body urging said head toward one side.

7. The toy figure set forth in claim 6 wherein said first pivot mechanism includes a first spring biasing said first pivot mechanism toward a wings-raised and legs-apart configuration.

8. The toy figure set forth in claim 6 wherein said first pivot mechanism includes a first spring biasing said first pivot mechanism toward a wings-raised and legs-apart configuration.

* * * * *